United States Patent [19]

Silvestri, Jr.

[11] 4,277,944

[45] Jul. 14, 1981

[54] METHOD AND APPARATUS FOR REGENERATIVELY SUPERHEATING AUXILIARY STEAM

[75] Inventor: George J. Silvestri, Jr., Aston, Pa.

[73] Assignee: Westinghouse Electric Corp., Pittsburgh, Pa.

[21] Appl. No.: 83,436

[22] Filed: Oct. 10, 1979

[51] Int. Cl.[3] ..... F01K 7/44

[52] U.S. Cl. ..... 60/670; 60/652

[58] Field of Search ..... 60/643, 645, 670, 652; 122/441

[56] References Cited

U.S. PATENT DOCUMENTS

| | | | |
|---|---|---|---|
| 3,523,421 | 8/1970 | Schuetzenduebel | 60/652 |
| 3,972,196 | 8/1976 | Silvestri, Jr. | 60/670 X |

*Primary Examiner*—Allen M. Ostrager
*Attorney, Agent, or Firm*—G. H. Telfer

[57] ABSTRACT

A method and apparatus for converting high pressure, high temperature elastic fuild (such as steam) to elastic fluid having a desired relatively low pressure and low temperature. Relatively high pressure, high temperature steam supplied from any point (preferably from a steam drum or equivalent location) in a steam cycle is initially throttled from a high temperature and pressure to a relatively intermediate temperature and pressure. Such intermediate temperature and pressure steam is routed through the tube side of a heat exchanger and subsequently throttled to a relatively low temperature and pressure. The resulting low temperature and pressure steam is then separated into its liquid and vapor phase components wherein the vapor phase is transmitted through the shell side of the heat exchanger and absorbs heat from the intermediate pressure, and temperature steam. The relatively low pressure, low temperature steam exiting the heat exchanger has the desired thermodynamic state. The temperature of the steam exiting the heat exchanger may be regulated by adjusting the high to intermediate pressure throttling device and the pressure of the low pressure steam exiting the heat exchanger may be regulated by adjusting the intermediate to low pressure throttling device. Such temperature and pressure regulation permits maintenance of steam temperature and pressure leaving the heat exchanger for varying temperatures and pressures of the relatively high pressure, high temperature steam supply. Such temperature and pressure maintenance enables elastic fluid utilizing devices to operate efficiently and reliably for fluctuating pressures and temperatures of the supply source.

6 Claims, 2 Drawing Figures

METHOD AND APPARATUS FOR REGENERATIVELY SUPERHEATING AUXILIARY STEAM

BACKGROUND OF THE INVENTION

1. Field of the Invention

This invention relates to steam power cycles, and more particularly, to means for supplying steam of desired temperature and pressure to a feed pump turbine for any operating condition of the steam cycle.

2. Description of the Prior Art

In large central station power generation facilities feed pumps which circulate the cycle's expandable fluid are often driven by steam turbines. The main steam turbines through which the cycle fluid is customarily expanded so as to drive associated generators are separated into at least high pressure and low pressure portions. Cycle fluid (commonly steam) serially expands through the high pressure turbine portion and the low pressure turbine portion. A turbine crossover conduit provides the means by which the cycle fluid passes from the high pressure turbine portions's exhaust to the low pressure turbine portion's inlet.

For normal loads (approximately 35% and greater) on the main turbine the boiler feed pump turbine typically receives steam from the turbine crossover or other location of similar pressure (approximately 100 PSIA). For main turbine load levels below approximately 35% (startups, shutdowns, emergency load runbacks) the crossover steam pressure becomes insufficient to operate the boiler feed pump turbine and the feed pump turbine is usually supplied with high pressure, high temperature steam from the turbine's throttle prior to entry into the high pressure turbine portion. However, operation with such high pressure, high temperature throttle steam is thermodynamically very inefficient due to the large extent of irreversible throttling required to reduce the steam pressure through the boiler feed pump turbine's control valves. For fossil fueled plants steam pressure at the main turbine throttle is normally in the range of 2000–3000 psi while boiler feed pump turbines typically utilize steam pressures which fall in the range of 80 to 180 psi. Such extreme throttling through the boiler feed pump turbine control valves is highly undesirable due to the inherent inefficiency and of the rather expensive and relatively scarce fossil fuel. Additionally, the resulting throttled steam temperature is sufficiently high to necessitate the use of a separate, high temperature steam chest and nozzle chamber which minimize thermal stresses normally induced in the boiler feed pump turbine when the steam source is changed from crossover (normal) origin to main turbine throttle origin.

For steam power cycles utilizing steam drum boilers it has been proposed to use dry and saturated steam from the steam drum and transmit that steam to the feed pump turbine for main turbine loads below approximately 35%. However, if dry and saturated steam at 2400 psi (typical value for steam drums) is throttled to 100 psi (typical value for boiler feed pump turbines) then steam at the boiler feed pump turbine inlet will include 9 to 10% water and in excess of 17% water at the feed pump turbine exhaust. Such large moisture percentages can cause severe erosion throughout the feed pump turbine. Additionally, when the load drops below the 35% level, the temperature changes from superheated crossover steam (530° to 730° F. typically) to drum steam throttled to 100 psi which is 328° F. As can be seen the potentially large temperature change from 200° to 400° F. can be harmful to the feed pump turbine.

In liquid metal fast breeder reactor (LMFBR) systems the normal (35% load and above) supply steam for the feed pump turbine is crossover steam whose temperature falls in the range between 470° and 530° F. Should high temperature fossil fuel practice be followed, throttle steam at 800° to 950° F. will be used for LMFBR system main turbine loads of less than approximately 35% with all the attendant, previously mentioned disadvantages. However, under certain emergency conditions it may be necessary to use dry and saturated drum steam in the 2400 psi range. As such, the feed pump turbine could be exposed to steam having successive nominal temperatures of 500° F., 800° F.and 330° F. in a short time span. Such rapid temperature variation thermally shocks the turbine severely and can lead to lower performance of and/or serious damage to the turbine.

The schemes heretofore utilized in supplying steam to boiler feed pump turbines for off-design operating conditions suffered from inefficiency, extraordinarily harsh duty, or both. A source of steam for the feed pump turbine is clearly needed for main turbine loads of less than approximately 35% such that the steam supplied thereby is not unduly throttled (to introduce inefficiency) nor of substantial temperature difference from main turbine crossover steam.

SUMMARY OF THE INVENTION

In accordance with the present invention a system and method are provided for converting relatively high pressure, high temperature elastic fluid to elastic fluid having desired pressure and temperatures which fall within predetermined ranges. The system generally comprises regulating means for throttling the pressure of a high pressure fluid to an intermediate pressure, heat exchanger means for transferring heat from the intermediate pressure elastic fluid to an elastic fluid of low pressure and temperature, regulating means downstream from and in fluid communication with the heat exchanger means for throttling the pressure of the intermediate pressure fluid, and means for separating vapor and liquid phases of the low pressure elastic fluid with the vapor phase of the low pressure fluid being in fluid communication with the heat exchanger means. The heat exchanger means transfers heat to the low pressure vapor and exhausts it at the desired temperature and pressure.

The method for supplying elastic fluid having pressures and temperatures which are adjustable within predetermined ranges generally comprises regulating the pressure of a high pressure elastic fluid to an intermediate pressure, regulating the pressure of the intermediate pressure elastic fluid to a desired low pressure, separating low pressure elastic fluid vapor from liquid and transferring heat in a heat exchanger from the intermediate pressure elastic fluid to the low pressure elastic fluid vapor to provide the desired low pressure elastic fluid temperature. The high pressure fluid pressure regulation preferably constitutes throttling in response to the temperature of the low pressure fluid exiting the heat exchanger with the throttling being increased for low pressure elastic fluid temperatures which are greater than desired and the throttling being decreased for low pressure fluid temperatures less than desired. In a preferred way to practice the invention the intermediate pressure regulation includes throttling the intermediate pressure fluid in response to the low pressure fluid's pressure exiting the heat exchanger with the throttling being increased for low pressure fluid pressures greater than desired and the throttling being decreased for low pressure fluid pressures less than desired. As such, the system and method provide a regenerative superheating of elastic fluid taken from a source having higher pressure and temperature than the desired pressure and temperature wherein the low pressure fluid may be supplied to any utilizing device such as a feed pump turbine in a steam power cycle.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

The present invention is concerned primarily with converting relatively high pressure, high temperature steam into steam having a desired relatively low pressure and temperature for use in boiler feed pump turbines of power cycles. Accordingly, in the description which follows the invention is shown embodied in a steam power cycle. It should be understood, however, that the invention may be utilized as a steam supply means in any process.

Figure 1:
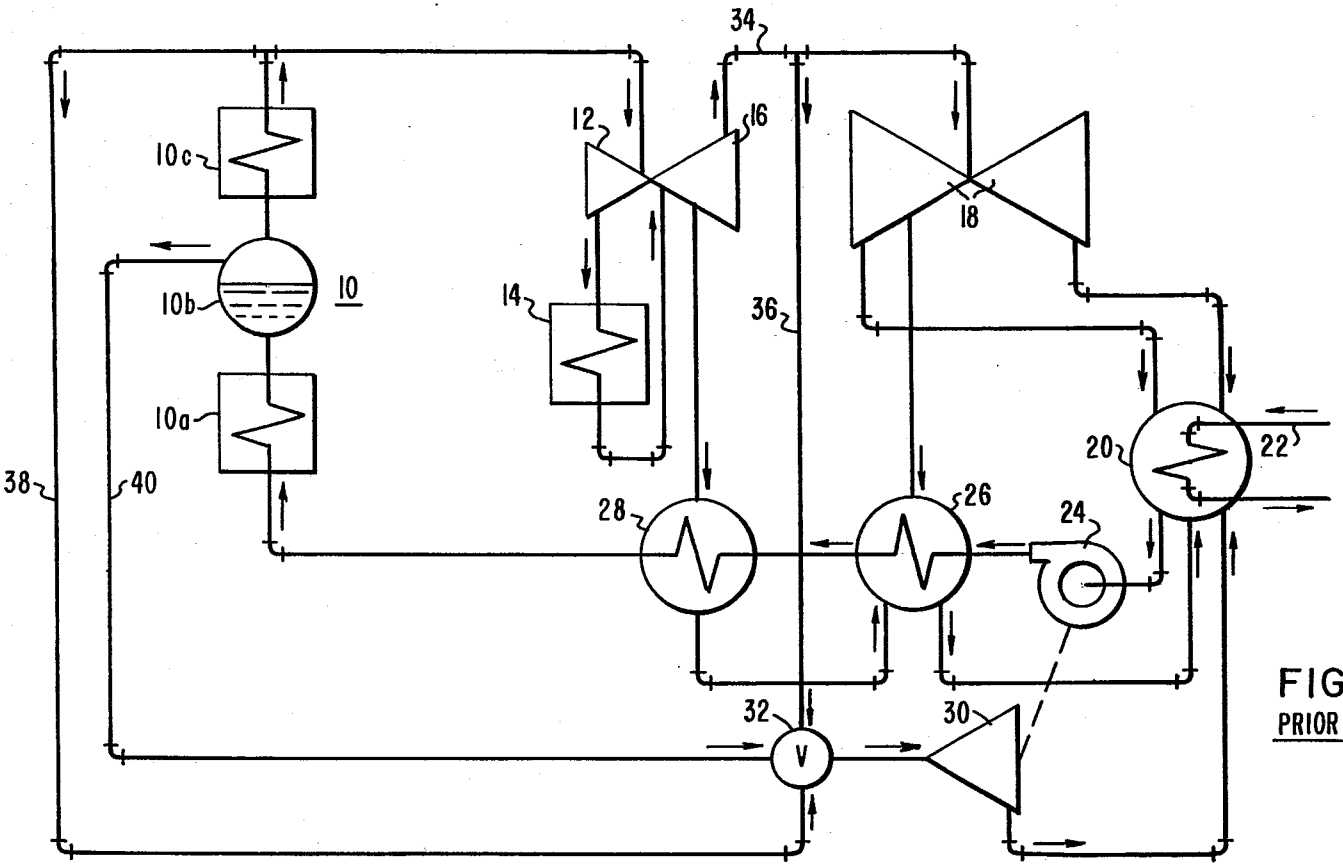
FIG. 1 PRIOR ART
FIG. 1 is a schematic view of a steam power cycle incorporating prior art steam sources for boiler feed pump turbine operation during low loading of an associated, main turbine.

FIG. 1 illustrates a schematic view of a steam power cycle in which a prior art steam supply system for a boiler feed pump turbine is utilized. Steam or other elastic fluid is produced in boiler structure 10 which includes evaporator portion 10*a*, steam drum or separator manifold 10*b*, and superheater 10*c*. Boiler structure 10 may be a conventional, fossil fired heat exchanger, nuclear steam generator, or any other source of heating energy for purposes of the present invention. Most steam leaving superheater section 10*c* is transmitted to high pressure turbine portion 12 through which the steam expands and converts its energy into rotational mechanical energy. The turbine's mechanical energy is used to drive a generator (not illustrated) which produces electrical energy. Throughout the description, the illustrated arrows indicate normal flow directions of the fluid utilized in the power cycle. Steam exhausting from high pressure turbine portion 12 enters reheater 14 which raises the energy of the steam prior to its entry into intermediate pressure turbine portion 16. Steam expanding through intermediate pressure turbine portion 16 exhausts therefrom into the schematically illustrated double flow low pressure turbine portion 18. The turbine portions 12, 16, and 18 may be connected to a common shaft or separate shafts for purposes of the present invention. Additionally, steam reheater 14, while illustrated as being between high pressure and intermediate pressure turbine portions 12 and 16 respectively, is commonly disposed between intermediate pressure and low pressure turbines 16 and 18, respectively, for steam power cycles utilizing nuclear fuel as the heat source.

Steam supplied to low pressure turbine portion 18 expands therethrough and exhausts into condenser 20 which maintains a relatively low pressure in the cycle and, in the illustrated case where water is used, condenses the steam. Coolant circulated through lines 22 removes heat from the steam or other elastic fluid. Condensed fluid is extracted from condenser 20 by feed pump 24 and is transmitted through serially connected feedwater heaters 26 and 28 prior to being returned to boiler structure 10.

Feed pump 24 is driven by feed pump turbine 30. During normal operation, steam is typically supplied to feed pump turbine 30 through valve apparatus 32 from crossover steam conduit 34 which extends between intermediate and low pressure turbines 16, 18, respectively. Steam extracted from crossover 34 is routed to a valve apparatus 32 through conduit 36. In the case of a nuclear steam supply, conduit 36 is situated downstream from reheater 14 which is typically disposed between turbine portions 16 and 18. Steam pressure in crossover 34 commonly falls in the range of 80 to 180 psi and is superheated. Normal operation is nominally at 35% and greater load on turbine portions 12, 16 and 18. However, for loads below approximately 35%, steam from the turbine throttle is usually routed through conduit 38 to valve apparatus 32. Use of such high pressure, high temperature throttle steam necessitates extensive throttling thereof prior to its entry into feed pump turbine 30 which typically operates in the range of 80 to 180 psi. Throttling of the main turbine's throttle steam is an irreversible, inefficient process which can substantially increase the steam cycle's heat rate and decrease the efficiency. Furthermore, the temperature of the main turbine throttle steam is drastically higher than crossover steam and thermally stresses the steam chest and nozzle chamber which, during normal operating conditions, carries crossover steam. As a result, separate steam chests and nozzle chambers are utilized for loads less than 35%. Use of such separate nozzle chambers and steam chest on the feed pump turbine 30 greatly increased the feed pump turbine cost and complicated its controls.

An alternative scheme for supplying feed pump turbine 30 is also illustrated in FIG. 1. For main turbine loads below approximately 35% capacity, dry and saturated steam from steam drum 10*b* may be routed through conduit 40 to feed pump turbine valve apparatus 32. While drum steam temperature is lower than that at the turbine throttle, its pressure closely approaches that of the steam at the turbine throttle and thus necessitates substantial throttling prior to entry into boiler feed pump turbine 30. However, throttling prior of dry and saturated drum steam (typically approximately 2400 psi) to 100 psi will result in 9 to 10% water at the feed pump turbine's inlet and in excess of 17% moisture at the feed pump turbine's exhaust. Such moisture can severely erode the feed pump turbine and force an outage thereof for repair or replacement. Additionally, thermal shock and thermal stress may be severe when the steam source for feed pump turbine 30 is switched from superheated crossover steam (typically 532° to 730° F.) to throttled drum steam (328° F. if throttled to 100 psi). The potential temperature difference during such switch is approximately 200° to 400° F. Although a conventional drum 10*b* has been illustrated, 10*b* is also intended to represent an intermediate header for once-through boilers which do not have steam drums.

For liquid metal fast breeder reactor (LMFBR) plants the aforementioned problems are compounded. For normal power cycles either main turbine throttle steam or boiler drum steam is utilized rather than both being provided as alternatives. For LMFBR's, however, operating restrictions necessitate use of the illustrated (in FIG. 1) redundancies. That is, for loads below approximately 35%, throttle steam (approximately 800° to 950° F.) from the main turbine is to be utilized. Crossover steam in LMFBR's systems is used as the normal (above 35% load) feed pump turbine steam source and has a temperature which falls in the approximate range of 470° to 530° F. Under emergency conditions, however, it may be necessary to use the dry and saturated drum steam in the 2400 psi range having a temperature of approximately 330° F. when throttled to 100 psi. As such, under certain conditions, the feed pump turbine could successively receive steam at 500° F. from the crossover, 800° F. from the main turbine throttle, and 330° F. when throttled from the boiler drum. Such temperature variations over a short time span can induce high thermal stresses and temperature shocks which can adversely affect the life and performance of the feed pump turbine 30. Although the illustrated steam cycle has two feedwater heaters 26 and 28, it is to be understood that any number of feedwaters heaters may be utilized with the present invention.

Figure 2:
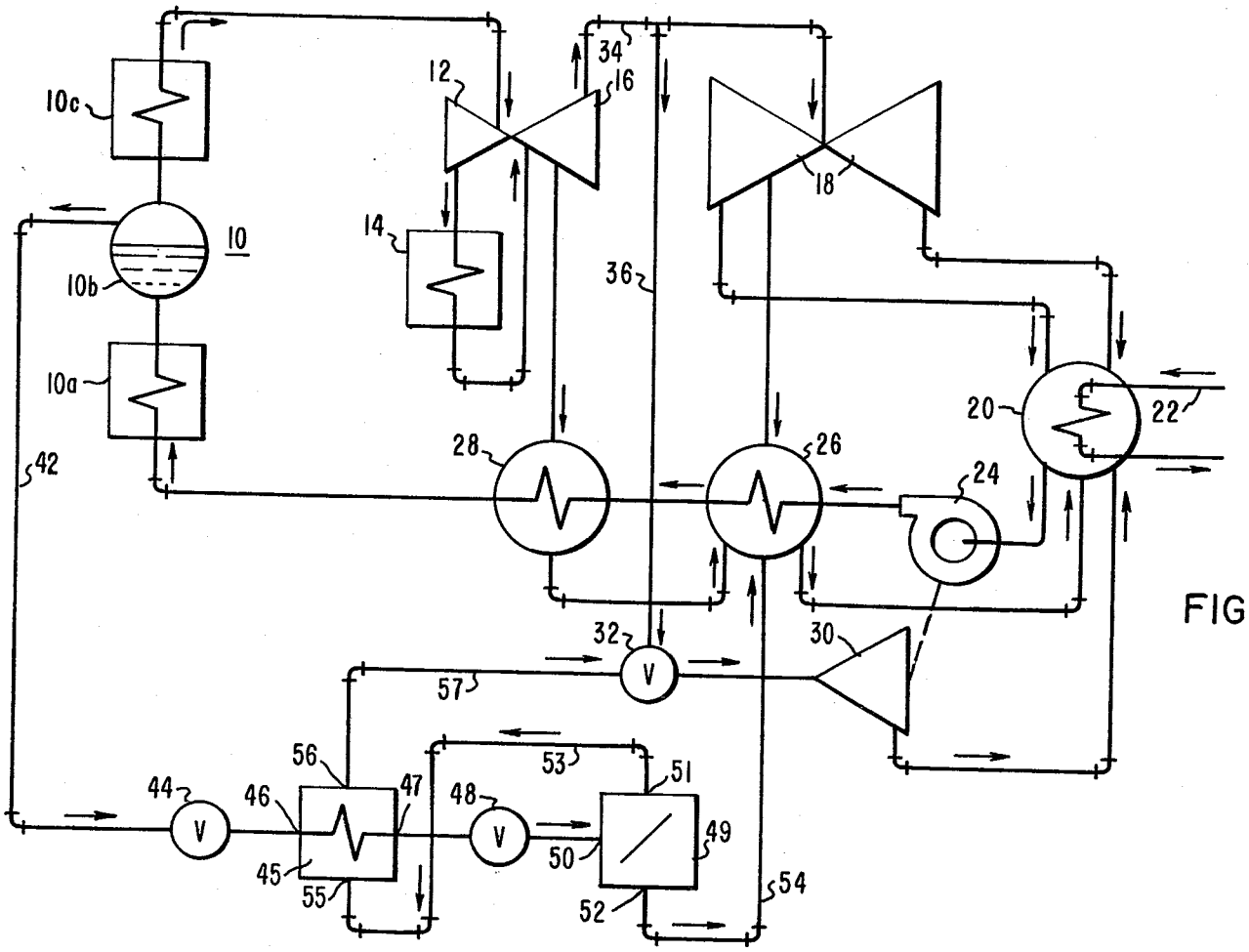
FIG. 2 is a schematic view of a steam power cycle incorporating the present inventive system and illustrating its method of operation.

FIG. 2 illustrates the present invention as incorporated in a steam power cycle similar to FIG. 1. During normal operation (above 35% main turbine load capacity), the boiler feed pump turbine 30 is supplied with steam from crossover 34 through valve apparatus 32. However, during startup, shutdown, low load, and emergency operating conditions, steam is supplied to the boiler feed pump turbine 30 from steam drum or intermediate header **10*b*. Steam bled from steam drum 10*b* through supply conduit 42 is throttled a predetermined amount by control valve 44 to an intermediate pressure and temperature. The intermediate pressure steam enters heat exchanger (reheater) 45 through intermediate pressure inlet opening 46, exits heat exchanger 45 through intermediate pressure outlet opening 47, and is subsequently further throttled to a relatively low pressure and temperature by throttling valve 48. The low pressure vapor and liquid phases enter separator 49 through inlet port 50, are segregated, and are respectively routed from separator 49 through outlet ports 51 and 52 which are respectively connected to lines 53 and 54. Liquid leaving separator 49 through line 54 is cascaded to one of the feedwater heaters to utilize the energy remaining in the liquid and regeneratively heat the cycled feedwater (26 in this case). The relatively low pressure vapor leaving separator 49 through line 53 is transmitted through low pressure inlet opening 55 to heat exchanger 45 where heat from the intermediate pressure and temperature fluid is transferred thereto. As a result of the heat transfer, the temperature of the low pressure fluid is increased prior to the low pressure fluid's transmission through low pressure outlet opening 56, through conduit 57 to valve apparatus 32. The temperature of the low pressure fluid traversing conduit 57 may be increased by decreasing the throttling of the control valves 44 and the pressure of the fluid traversing conduit 57 may be increased by decreasing the throttling of throttling valve 48. As can be seen suitable manipulation of valves 44 and 48 permit the desired pressure, temperature, and the flow rate of the fluid traversing the conduit 57** to be attained.

While dry and saturated steam from intermediate header **10*b* has been illustrated as feeding heat exchanger 45**, it is to be understood that the present invention could operate with equal facility from steam supplied thereby having a state point in the supercritical region. For example, steam at 3500 psi and 770° F. could be throttled to 2400 psi and have only about 25° F. of superheat.

Suitable adjustment of valves 44 and 48 permit drum steam at 2400 psi and 662° F. to be utilized in providing steam at a desired pressure (approximately 100 psia) and a desired temperature (within the range of 400° F. to 625° F.) to the feed pump turbine 30. Since the temperature of the steam provided to the feed pump turbine can be regulated, thermal shock to the feed pump turbine as sometimes occurs during start-up can be minimized. The 100 psia steam is thus superheated and readily usable by boiler feed pump turbine 30. While heat exchanger 45 and separator 49 are schematically illustrated as separated devices, it is to be understood that the devices may be combined on a single apparatus. By operating the illustrated apparatus in the aforementioned manner disadvantages previously experienced by excessive throttling of main turbine throttle steam and the high moisture content of throttled drum steam may be avoided. Additionally, the redundant steam chest and nozzle chamber necessary for passing high temperature main turbine throttle steam therethrough on prior art boiler feed pump turbines is eliminated and the associated high cost is avoided.

I claim:

1. A system for providing elastic fluid having a pressure and temperature which are adjustable within a predetermined range comprising:

means for regulating a high pressure fluid's pressure to an intermediate pressure;

heat exchanger means for transfering heat from the intermediate pressure elastic fluid to an elastic fluid of low pressure and temperature, said heat exchanger means having an intermediate pressure fluid inlet opening, an intermediate pressure fluid outlet opening, a low pressure inlet opening, and a low pressure fluid outlet opening, said intermediate pressure fluid inlet opening being in fluid communication with said high pressure regulating means, said low pressure fluid exiting said low pressure fluid outlet opening being at the desired pressure and temperature;

means for regulating the pressure of the intermediate pressure fluid to a low pressure, said intermediate pressure fluid regulating means being in fluid communication with said intermediate pressure fluid outlet opening; and means for separating vapor and liquid phases of the low pressure elastic fluid, said separating means having an inlet port in fluid communication with said intermediate pressure fluid regulating means, a liquid outlet port for expelling separated low pressure elastic fluid liquid, and a vapor outlet port in fluid communication with said heat exchanger means' low pressure inlet opening for transmitting said low pressure vapor thereto.

2. A method for supplying elastic fluid having a pressure and temperature which are adjustable within a predetermined range, said method comprising:

regulating the pressure of a high pressure elastic fluid to an intermediate pressure;

regulating the pressure of the intermediate pressure elastic fluid to a desired low pressure;

separating low pressure elastic fluid vapor from liquid; and transferring heat in a heat exchanger from the intermediate pressure elastic fluid to the low pressure elastic fluid vapor so as to provide the desired low pressure elastic fluid temperature.

3. The method of claim 2, said high pressure fluid pressure regulation constituting:

throttling in response to the low pressure fluid's temperature exiting the heat exchanger.

4. The method of claim 3 wherein said throttling is increased for low pressure fluid temperatures greater than desired and said throttling is decreased for low pressure fluid temperatures less than desired.

5. The method of claim 2, said intermediate pressure fluid pressure regulation constituting:

throttling in response to the low pressure fluid's pressure exiting the heat exchanger.

6. The method of claim 5 wherein said throttling is increased for low pressure fluid pressures greater than desired and said throttling is decreased for low pressure fluid pressures less than desired.

* * * * *